US008752871B2

(12) United States Patent
Rechberg et al.

(10) Patent No.: US 8,752,871 B2
(45) Date of Patent: Jun. 17, 2014

(54) WIRE STRIKE ASSEMBLY

(75) Inventors: Frank H. Rechberg, Corona, CA (US); Jason A. Rechberg, Anaheim, CA (US)

(73) Assignee: Actron Manufacturing, Inc., Corona, CA (US)

( * ) Notice: Subject to any disclaimer, the term of this patent is extended or adjusted under 35 U.S.C. 154(b) by 427 days.

(21) Appl. No.: 13/188,355

(22) Filed: Jul. 21, 2011

(65) Prior Publication Data

US 2013/0020919 A1 Jan. 24, 2013

(51) Int. Cl.
*E05B 15/02* (2006.01)
*E05B 15/00* (2006.01)

(52) U.S. Cl.
USPC ..... 292/340; 292/341.18

(58) Field of Classification Search
USPC ..... 292/340, 341.18, 341.19
See application file for complete search history.

(56) References Cited

U.S. PATENT DOCUMENTS

| | | | | | |
|---|---|---|---|---|---|
| 311,787 | A | * | 2/1885 | Rockfellow | 292/169.21 |
| 1,557,765 | A | | 10/1925 | Nicholas | |
| 1,869,815 | A | * | 8/1932 | Katz | 292/341.18 |
| 1,910,208 | A | | 5/1933 | Gronberg et al. | |
| 2,547,513 | A | | 4/1951 | Wikman | |
| 2,752,219 | A | | 6/1956 | Yonkers | |
| 3,074,766 | A | | 1/1963 | Meyer | |
| 3,259,447 | A | | 7/1966 | Deutsch | |
| 3,401,998 | A | | 9/1968 | Evans et al. | |
| 3,773,395 | A | | 11/1973 | Antonaccio | |
| 3,801,166 | A | | 4/1974 | York | |
| 3,937,531 | A | | 2/1976 | Hagen et al. | |
| 4,067,632 | A | | 1/1978 | Sekerich | |
| 4,423,914 | A | | 1/1984 | Vanderley | |
| 4,441,772 | A | | 4/1984 | Fielding et al. | |
| 4,451,071 | A | * | 5/1984 | Striese et al. | 292/341.18 |
| 4,469,384 | A | | 9/1984 | Fler et al. | |
| 4,537,450 | A | | 8/1985 | Baxter | |
| 4,691,952 | A | * | 9/1987 | Harmon | 292/341.18 |
| 4,749,242 | A | | 6/1988 | Rechberg | |
| 4,798,408 | A | * | 1/1989 | Harmon et al. | 292/341.18 |
| 4,852,923 | A | * | 8/1989 | Harmon et al. | 292/341.18 |
| 4,906,037 | A | * | 3/1990 | Stammreich et al. | 292/341.18 |
| 4,932,792 | A | | 6/1990 | Baxter | |
| 4,988,214 | A | | 1/1991 | Clement | |
| 5,016,931 | A | * | 5/1991 | Jackson | 292/341.18 |
| 5,127,684 | A | * | 7/1992 | Klotz et al. | 292/113 |
| 5,234,238 | A | * | 8/1993 | Takimoto | 292/216 |
| 5,484,176 | A | * | 1/1996 | Sallwasser | 292/137 |
| 6,000,737 | A | * | 12/1999 | Yiu | 292/340 |
| 6,126,255 | A | | 10/2000 | Yang | |
| 6,244,678 | B1 | | 6/2001 | Dopp et al. | |
| 6,382,690 | B1 | * | 5/2002 | Dessenberger, Jr. | 292/341.18 |
| 6,435,636 | B1 | | 8/2002 | MacMillan | |
| 7,360,810 | B2 | * | 4/2008 | Dennis | 292/341.18 |
| 7,469,945 | B2 | * | 12/2008 | Dennis | 292/340 |
| 7,537,296 | B2 | | 5/2009 | Leon et al. | |
| 8,113,551 | B2 | * | 2/2012 | Baic et al. | 292/113 |
| 8,382,171 | B2 | * | 2/2013 | Williams | 292/341 |
| 2008/0218046 | A1 | | 9/2008 | Rechberg | |

OTHER PUBLICATIONS

Admitted Prior Art: Photographs (2) showing a Carrier and Piston manufactured by RD Hardware (www.rdhardware.com).

* cited by examiner

*Primary Examiner* — Carlos Lugo
(74) *Attorney, Agent, or Firm* — Stetina Brunda Garred & Brucker

(57) ABSTRACT

A wire strike assembly for use with a latch mechanism having an adjustment mechanism and locking mechanism to enable the wire strike assembly to be readily adjusted to align with the latch in an efficient and fail safe manner.

14 Claims, 7 Drawing Sheets

WIRE STRIKE ASSEMBLY

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates generally to a wire strike assembly for use with a drawer housing.

The drawers found in desks, filing cabinets, and other storage fixtures or furnishings may become dislodged if the drawer is subject to forces caused by excess vibration, jarring, and other movements. Cabinets and other storage furnishing used on commercial shipping and trucks or on aircraft are especially likely to experience the vibrational effects that may result in the drawer being unintentionally opened during transit. As a result, the contents of files, supplies, and even valuables stored in these drawers used in commercial vehicles are more likely to fall out, be removed without permission, lost or even destroyed with the drawer unintentionally opened by the vibrational effects experienced during transit.

It is understood that prior art wire strikes that are mountable to the top face of a drawer housing are configured to receive a spring-biased latch that may be a component of a locking assembly on the drawer. However, in order to mount the wire strike on the top face such that it is properly positioned to receive the spring-biased latch, it is understood that these prior art devices require the entire wire strike to be remounted onto the top face if its original position is not properly aligned with the spring-biased latch or otherwise requires adjustment. As a result, the proper fitting of the wire strike on the top face of the drawer housing in these prior art devices may be a time consuming process requiring meticulous measurement of the positioning of the wire strike and the spring-biased latch. Accordingly, users of these prior art devices may end up misaligning the wire strike with the spring-biased latch or due to the difficulty involved in their proper installation, they may forgo the use of any wire strike on the top face of the drawer housing. As a result, the contents of drawers in commercial vehicles or airplanes utilizing prior art wire strike devices may end up being removed, lost, or destroyed in the same manner as if no wire strike device were being used. Therefore, short of physically locking the drawer (to the extent there is a lock) on each and every occasion, a drawer may be subject to vibrational forces, the contents of these drawers may not be sufficiently secure with the use of prior art wire strike devices. Even if the user remembers to lock the drawer on each occasion, the key used to open the drawer lock may be easily lost or the combination used to open the lock may be forgotten.

Accordingly, there appears to be a need in the art for a new wire strike assembly that enables the wire strike to be readily adjusted to align with the spring-biased latch in an efficient manner while the wire strike assembly remains mounted to the drawer housing.

BRIEF SUMMARY

According to an aspect of the present invention, there is provided a wire assembly for use with a drawer housing with the drawer housing having a top face, a drawer with a front face, and a spring-biased latch mountable to the front face. The wire strike assembly may comprise a wire strike having a wire strike first end and an opposing wire strike second end. The wire strike may further have a wire strike first side. The wire strike second end may be sized and configured to receive the spring-biased latch. The wire strike assembly may further include a mounting plate having a first face mountable to the top face of the drawer housing, a first channel, and a second channel. The mounting plate may further have a first wire strike groove sized and configured to receive the wire strike first end side. The wire strike assembly may further include an adjustment screw having an adjustment head and a threaded adjustment stem. The adjustment screw may be disposable through the first channel. The wire strike assembly may further have a locking screw having a locking head and a locking stem. The locking screw may be disposable in the second channel. The locking screw may be operative to lock the axial position of the adjustment screw with the locking head disposed against the adjustment head. The wire strike assembly may further include a wire strike slide having a recess sized and configured to receive the wire strike first end. The wire strike slide may further have a strike opening sized and configured to engage the threaded adjustment stem. The wire strike may be adjustable into a plurality of positions relative to the spring biased latch with the rotation of the threaded adjustment stem through the strike opening translated to the movement of the wire strike slide in a direction parallel to a wire strike longitudinal axis.

The wire strike assembly is innovative in that the adjustment screw and the locking screw enable the adjustment and fixing of the position of the wire strike with the spring-biased latch from the front of the wire strike assembly without needing to remount the wire strike assembly to the top face of the drawer housing. The locking head may be loosened in an amount that enables the adjustment of the locking screw, thereby enabling the modification of the position of the threaded adjustment stem through the strike opening of the wire strike slide. The rotation of the threaded adjustment stem may translate into the movement of the wire strike slide in a direction parallel to a wire strike longitudinal axis. The locking head and the adjustment head may be adjusted using a screwdriver such as a Philips®. Accordingly, the wire strike assembly may be efficiently aligned with the spring-biased latch and fixed into position once the proper alignment is found. Importantly, the wire strike assembly need not be removed and remounted to the top face of the drawer housing for adjustment, as is the case with prior art wire strike devices. As such, the wire strike assembly is more likely to be properly used in preventing the drawer as used in a commercial transport including aviation from inadvertently opening. This feature may uniquely prevent the contents of the drawer from being lost, removed, or destroyed during transit.

In one embodiment of the wire strike assembly, the wire strike may have a wire strike second side opposing the wire strike first side. The wire strike may further have a rectangular shape with the wire strike first end and the wire strike second end being orthogonally disposed between the wire strike first side and the wire strike second side. In this embodiment, the wire strike first side and the wire strike second side may be longer than the wire strike first end and the wire strike second end. However, it is contemplated within the scope of the present invention that the wire strike may be any shape that is suitable to the proper alignment of the wire strike with the spring-biased latch.

In another embodiment of the claimed invention, the mounting plate may have a second wire strike groove opposing the first wire strike groove. The second wire strike groove may be sized and configured to receive the wire strike second side.

The first channel of the mounting plate may be threaded to correspond to the threading pattern on the threaded adjustment stem. In a further embodiment, the mounting plate may further include a first channel notch approximate to the first channel that may be sized and configured to engage the distal end of the threaded adjustment stem. In another embodiment, the locking stem may also be threaded. In this embodiment, the mounting plate may have a second channel that is threaded to correspond to the threading pattern on the locking stem.

In yet a further embodiment, the strike opening on the wire strike slide may be a threaded hole operative to engage the threaded adjustment stem. This feature uniquely enables the rotation of the threaded adjustment stem through the strike opening to translate into the movement of the wire strike slide in a direction parallel to a wire strike longitudinal axis, thereby enabling the convenient adjustment of the wire strike assembly without removing it from the drawer housing. In another embodiment of the claimed invention, the mounting plate may include a top section mounted to the top face and an opposing bottom section. The bottom section may contain the first channel, the second channel, and the first wire strike groove. The top section and the bottom section of the mounting plate may have a coaxial hole through which may be disposed a fitting pin operative to secure the bottom section to the top section. In another embodiment, the top section and the bottom section may each have a plurality of coaxial holes with a separate fitting pin being disposed through each mounting hole to secure the bottom section and top section. In yet a further embodiment, the top section and the bottom section of the mounting plate may each have a coaxial mounting aperture through which may be disposed a mounting pin operative to mount the mounting plate to the top face.

Although the adjustment head and the locking head may have a Philips® screwdriver head configuration in a preferred embodiment of the wire strike assembly, it is also contemplated within the scope of the present invention that the various aspects of the adjustment head and the locking head may have any configuration that may be readily accessed and adjusted from the front of the wire strike assembly without removing the mounting plate from the top shelf.

In another embodiment, the wire strike assembly may further include a washer through which the threaded adjustment stem may be disposed. The washer may be disposed proximate to the adjustment head with the threaded adjustment stem disposed through the strike opening.

The wire strike assembly may include a stopper device coupled to the mounting plate such that the stopper device is adjustable to engage with the drawer when the drawer is closed to mitigate contact between the wire strike and the drawer and to reduce vibration of the drawer as it is closed.

The wire strike assembly may further include a pair of wire strikes to provide additional support and durability.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and detailed description to indicate like elements.

DETAILED DESCRIPTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 5:
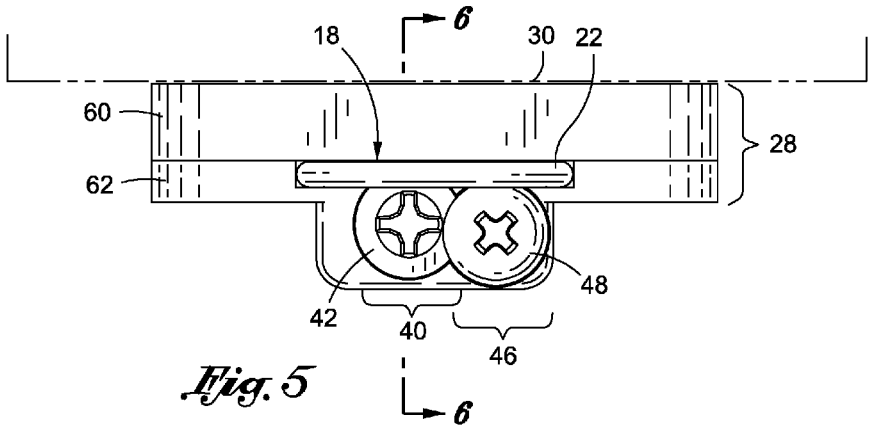
FIG. 5 is an end view of an embodiment of the wire strike assembly having a wire strike adjustment screw and a locking screw with the first face of the mounting plate mounted to the top face of the drawer housing.
Figure 6:
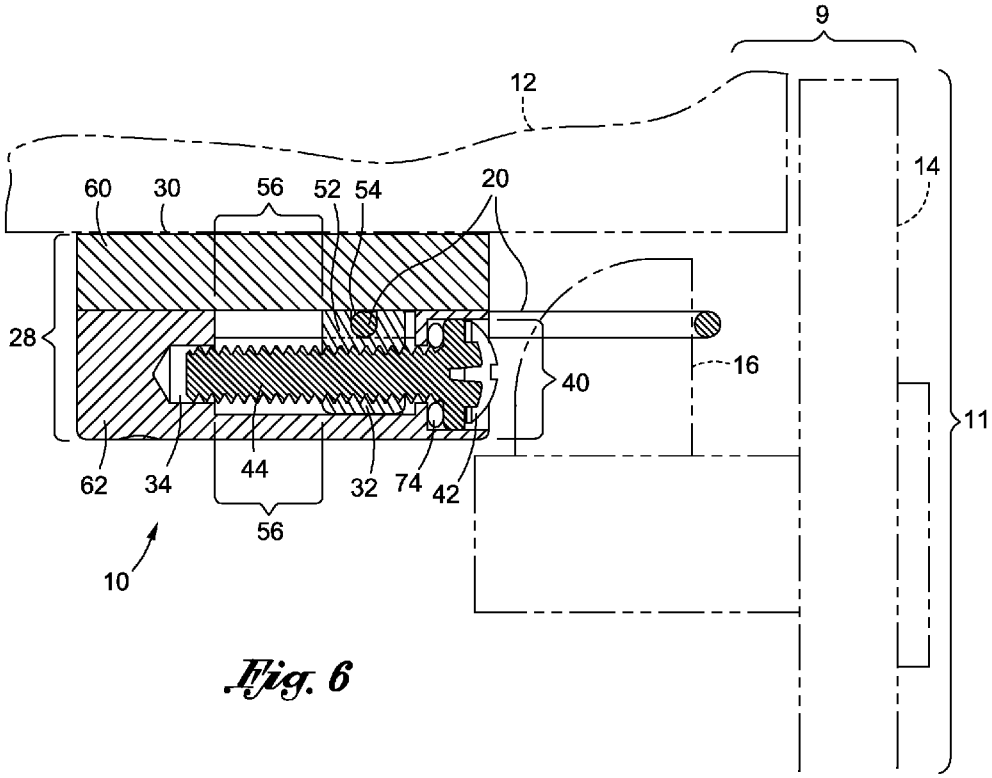
FIG. 6 is a cross-sectional side view of an embodiment of the wire strike assembly depicting a threaded adjustment stem disposed through a first channel into a first channel notch with the spring-biased latch on the front face of the drawer disposed through the wire strike.

The wire strike assembly 10 may be for use with a drawer housing 9 (see FIG. 6). The drawer housing 9 may have top face 12 and a drawer 11 with a front face 14 and a spring-biased latch 16 mountable to the front face 14. The wire strike assembly 10 may be mountable to the top face 12 on the drawer housing 9 (see FIG. 5). A mounting plate 28 may have a first face 30 mountable to the top face 12 (see FIG. 6). Wire strike 18 may be sized and configured to receive the spring-biased latch 16 on the drawer 11 (see FIG. 6). The wire strike 18 may have a wire strike first end portion 20, an opposing wire strike second end portion 22, and a wire strike first side portion 24. The wire strike 18 is connected to the mounting plate 28 such that the first end portion 20 extends from the mounting plate 28 to define an exposed end portion and the second end portion 22 defines an embedded end portion. The exposed end portion of the wire strike 18 and the mounting plate 28 collectively define an opening that is sized and configured to receive the spring biased latch 16 when the drawer is moved to the closed position.

Figure 4:
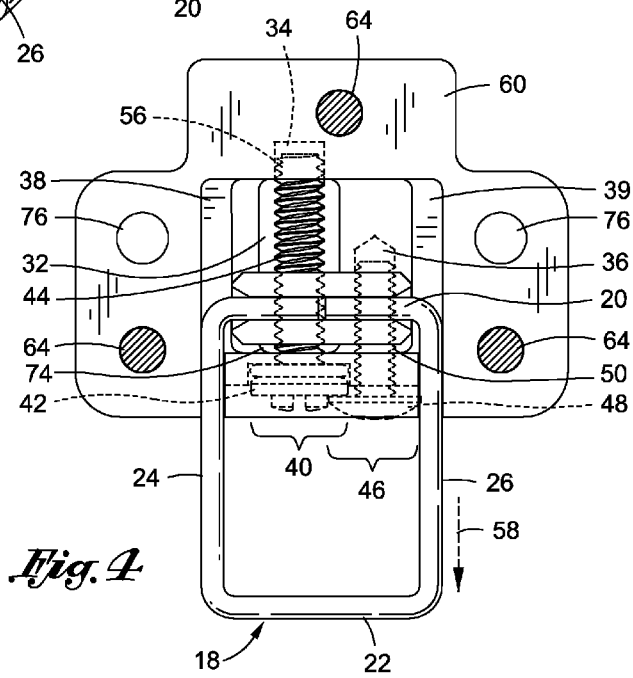
FIG. 4 is a top view of an embodiment of the wire strike assembly with a rectangular wire strike disposed in the recess of the wire strike slide, an adjustment screw with a threaded adjustment stem disposed through a threaded hole in the first channel, and a locking screw disposed in the second channel of the mounting plate.
Figure 7:
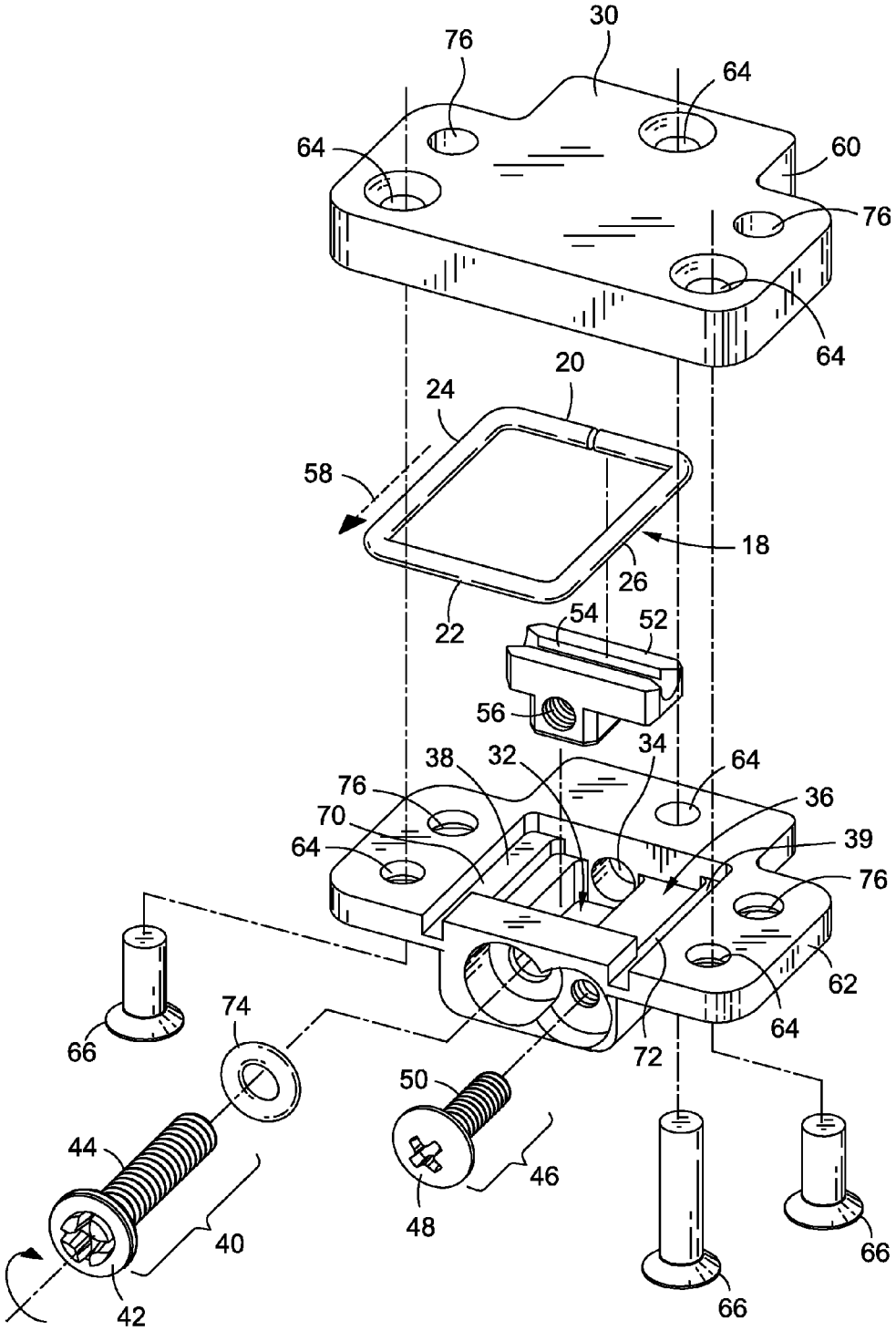
FIG. 7 is an exploded top view of an embodiment of the wire strike assembly showing the interior of the mounting plate with the top section secured onto the bottom section by way of a fitting pin disposed through each coaxial hole.

In the embodiment depicted in FIGS. 4 and 7, the wire strike 18 may also have a wire strike second side portion 26 opposing the wire strike first side portion 24. The mounting plate 28 may also have a first channel 32, a second channel 36, and a first wire strike groove 38 (see FIGS. 4 and 7). The first wire strike groove 38 may be sized and configured to receive the wire strike first end portion 20. In an embodiment of the wire strike assembly 10 having a wire strike second side portion 26, a second wire strike groove 39 may be sized and configured to receive the wire strike second side portion 26 (see FIGS. 4 and 7).

The wire strike assembly 10 may further have an adjustment member 40 operatively coupled to the first wire strike 18 for moving the first wire strike 18 relative to the mounting body 28. In the exemplary embodiment, the adjustment member 40 is a screw having an adjustment head 42 and a threaded adjustment stem 44 (see FIGS. 4, 6 and 7). The adjustment screw 40 may be disposable through the first channel 32 (see FIG. 6). In another embodiment of the wire strike assembly 10, the adjustment screw 40 may be further disposable into a first channel notch 34 approximate to the first channel 32. The first channel notch 34 may be sized and configured to engage the threaded adjustment stem 44 (see FIGS. 4, 6 and 7). In a preferred embodiment of the wire strike assembly 10, the first channel 32 may be threaded to correspond to the threading pattern on the threaded adjustment stem 44. A locking screw 46 having a locking head 48 and a locking stem 50 may be disposable in the second channel 36 (see FIGS. 4 and 7). The locking screw 46 may be operative to lock the axial position of the adjustment screw 40 with the locking head 48 disposed against the adjustment head 42 (see FIGS. 3, 4 and 5). In another embodiment of the wire strike assembly 10, the locking stem 50 may be threaded. The second channel 36 may likewise be threaded to correspond to the threading pattern on the locking stem 50.

Figure 3:
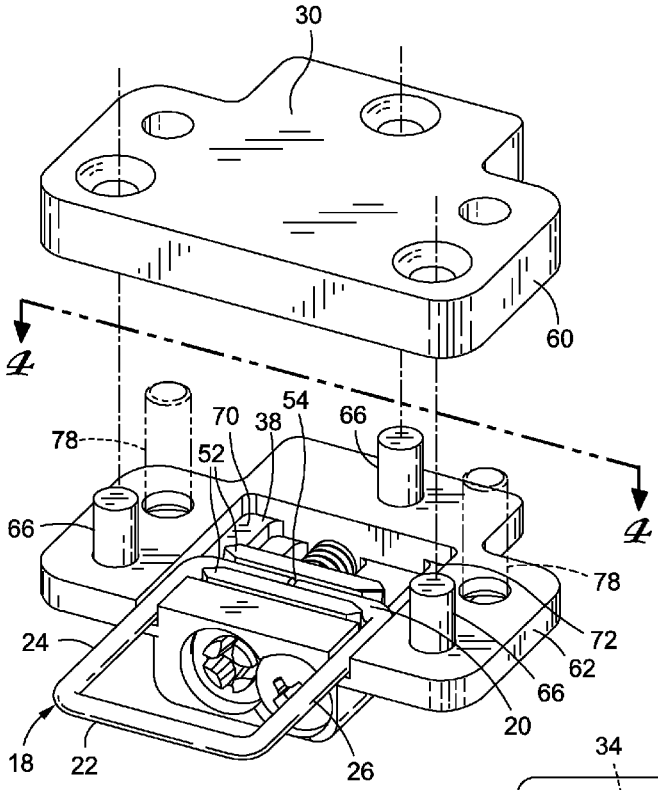
FIG. 3 is a perspective view of an embodiment of the interior of the wire strike assembly with the top section dislodged from the bottom section showing a rectangular wire strike.

The wire strike assembly 10 may further have a wire strike slide 52 with a recess 54 sized and configured to receive the wire strike first end portion 20 of the wire strike 18 (see FIGS. 3, 7). The wire strike slide 52 may further have a strike opening 56 sized and configured to engage the threaded adjustment stem 44 (see FIGS. 4, 6 and 7). The wire strike 18 may be adjustable into a plurality of positions relative to the spring-biased latch 16. The rotation of the threaded adjustment stem 44 through the strike opening 56 may translate into the movement of the wire strike slide 52 in a direction parallel to a wire strike longitudinal axis 58 (see FIGS. 4 and 7) with the modification of the position of the adjustment stem 44 through the strike opening 56 (see FIGS. 4 and 6). In a further embodiment, the strike opening 56 on the wire strike 52 may be a threaded hole 79 operative to engage the threaded adjustment stem 44. However, it is also contemplated within the scope of the present invention that the adjustment stem 44 and the locking stem 50 may have any exterior configuration that may be readily fitted in the strike opening 56 and the second channel 36 respectively.

Referring to FIG. 4, the wire strike 18 may have a rectangular shape with the wire strike first end portion 20 and the wire strike second end portion 22 being orthogonally disposed between the wire strike first side portion 24 and the wire strike second side portion 26. The wire strike first side portion 24 may be generally parallel to the wire strike second side portion 26. In this embodiment, the wire strike first side portion 24 and the wire strike second side portion 26 may be longer than the wire strike first end portion 20 and the wire strike second end portion 22 (see FIGS. 4 and 7). However, it is also contemplated within the scope of the present invention that the wire strike 18 may be any shape suitable for receiving the spring-biased latch 16. The wire strike groove 38 may have a first groove 70 configured to receive the wire strike first side portion 24 and a second groove 72 configured to receive the wire strike second side portion 26 wherein the wire strike 18 has a rectangular configuration (see FIGS. 3, 4 and 7).

Figure 1:
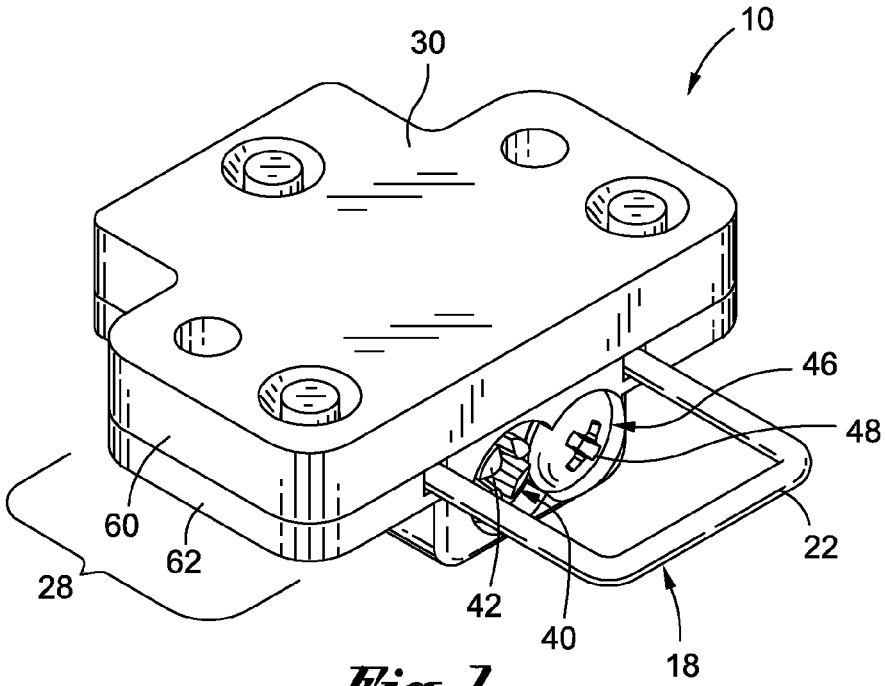
FIG. 1 is a top view of an embodiment of the wire strike assembly showing a top section, a bottom section, an adjustment screw, a locking screw, a wire strike, and a plurality of coaxial holes with fitting pins disposed therein.
Figure 2:
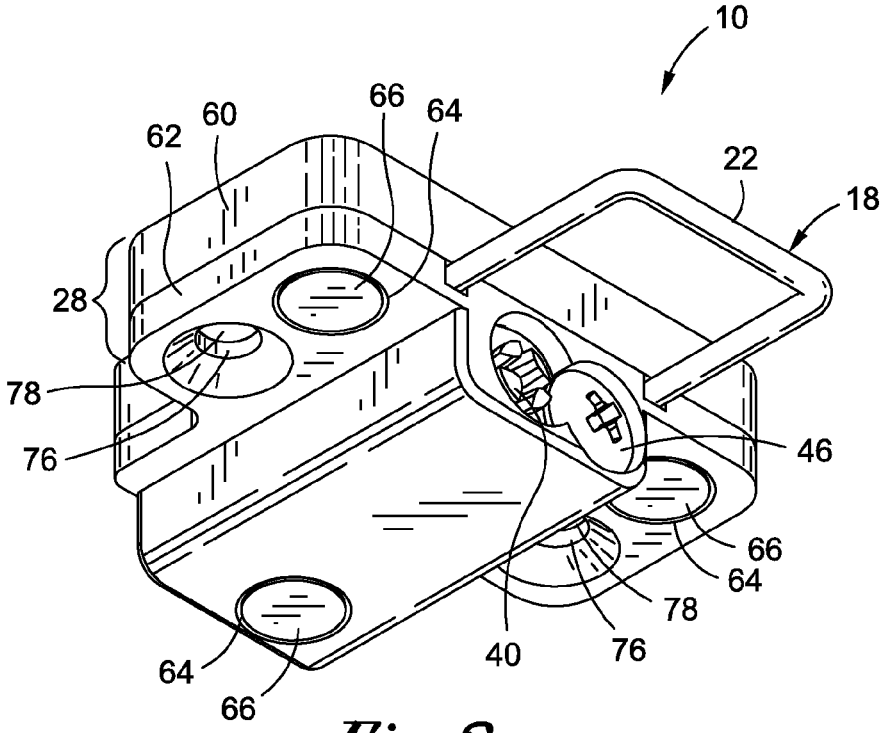
FIG. 2 is a bottom view from the bottom section of the mounting plate showing a wire strike, an adjustment screw, a locking screw, and a plurality of coaxial holes with fitting pins disposed therein.

A preferred embodiment of the wire strike assembly 10 is shown in FIGS. 1, 3 and 7, wherein the mounting plate 28 has a top section 60 mountable to the top face 12 and an opposing bottom section 62. The top section 60 may be secured to the bottom section 62 via mechanical fasteners, including screws, rivets, adhesives and other fasteners known in the art. According to one particular implementation, the top section 60 and the bottom section 62 may each have a coaxial hole 64 through which may be disposed a fitting pin 66 operative to mount the bottom section 62 to the top section 60. In another embodiment, the top section 60 and the bottom section 62 may have a plurality of coaxial holes 64 with a fitting pin 66 being disposed through each coaxial hole 64 (see FIGS. 1, 3, 4 and 7). The top section 60 and the bottom section 62 of the mounting plate 28 may also each have a coaxial mounting aperture 76 through which may be disposed a mounting pin 78 operative to mount the mounting plate 28 to the top face 12 of the drawer housing 9 (see FIGS. 3, 4 and 7).

Similarly, the adjustment head 42 of the adjustment screw 40 and the locking head 48 of the locking screw 46 may have a "Phillips"® configuration that are capable of being adjusted by a Phillips® screw driver from the front of the wire strike assembly 10 (see FIGS. 1, 2, 5 and 7). This feature uniquely enables the alignment of the wire strike 18 with the spring-biased latch 16 from the front of the wire strike assembly 10. As discussed above, the position of the adjustment stem 44 through the wire strike slide 52 may be modified by rotating the adjustment head 42 (with for example a screwdriver). This in turn results in the rotation of the threaded adjustment stem 44 through the strike opening 56, which translates into the movement of the wire strike slide 52 in a direction parallel to the wire strike longitudinal axis 58. Similarly, the locking head 48 may also lock against the adjustment head 42 with the turn of a screwdriver from the front of the wire strike assembly 10 (see FIGS. 4 and 5). As such, the wire strike assembly 10 need not be removed and remounted to the top face 12 of the drawer housing 9 should a modification in the alignment of the wire strike 18 with the spring-biased latch 17 being necessary. These features uniquely enable the wire strike assembly 10 to be aligned and fixed into position with the spring-biased latch 16 in a timely and efficient manner. This feature may encourage the user to take the time to properly align the wire strike assembly 10 with the spring-biased latch 16 so as to prevent a drawer 11 used in commercial transport such as an airplane from inadvertently opening. The contents of the drawer housing 9 may therefore be less likely to be lost, removed, or destroyed during transit.

In another embodiment, the adjustment stem 44 may be disposed through a washer 74. The washer 34 may be disposed proximate to the adjustment head 42 with the adjustment stem 44 threaded through the strike opening 56 (see FIG. 7).

Figure 8:
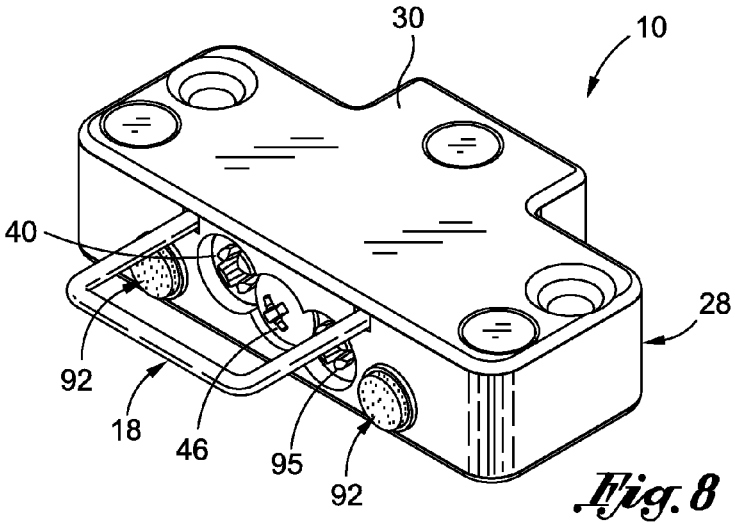
FIG. 8 is an upper perspective view of an embodiment of the wire strike assembly including moveably stopper device coupled to the mounting plate, wherein the stopper device is shown in a retracted position.
Figure 9:
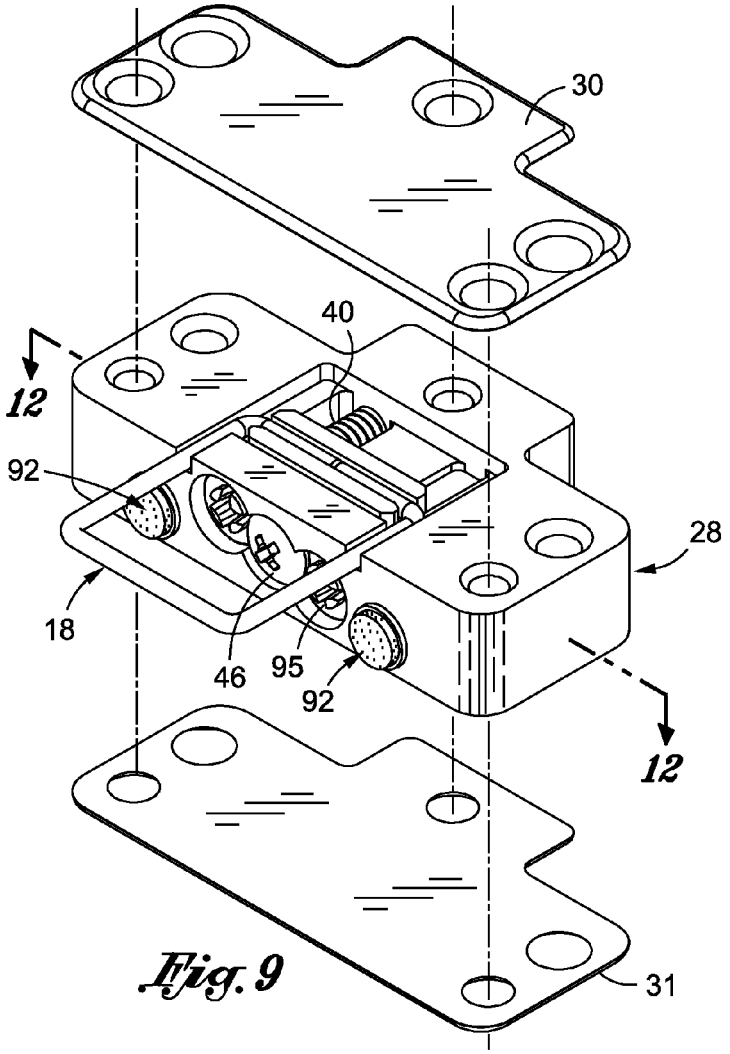
FIG. 9 is an exploded upper perspective view of the wire strike assembly depicted in FIG. 8.
Figure 10:
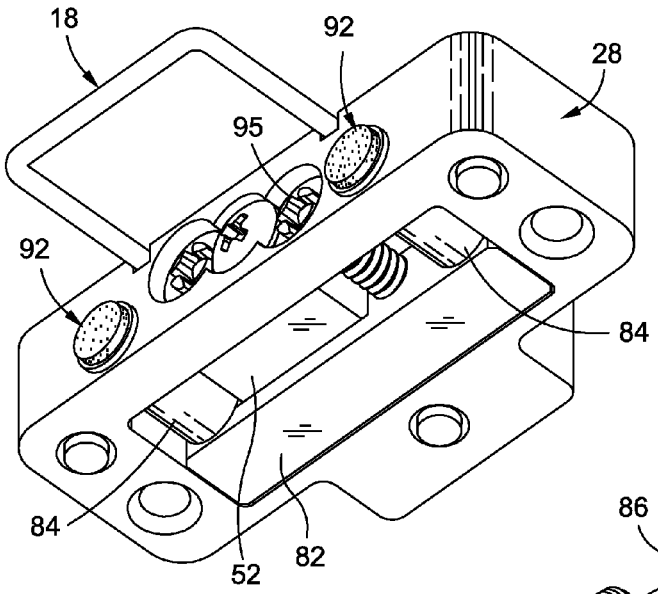
FIG. 10 is a lower perspective view of the wire strike assembly shown in FIG. 9 with a lower plate removed to show the stopper device.
Figure 11:
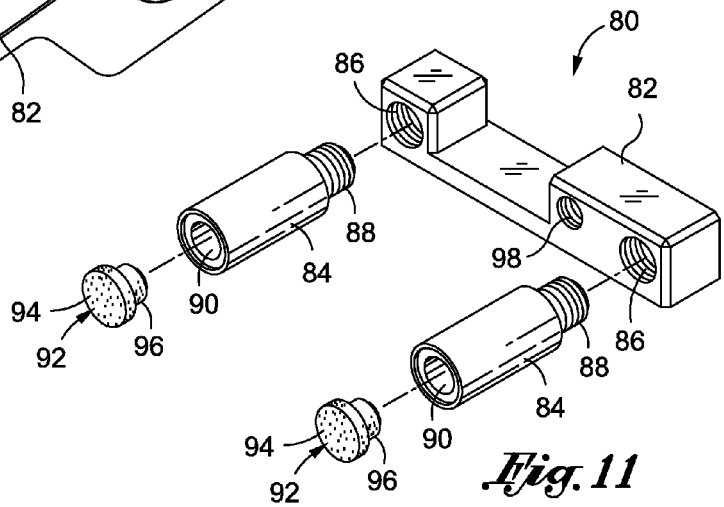
FIG. 11 is an exploded upper perspective view of the stopper device.
Figure 12:
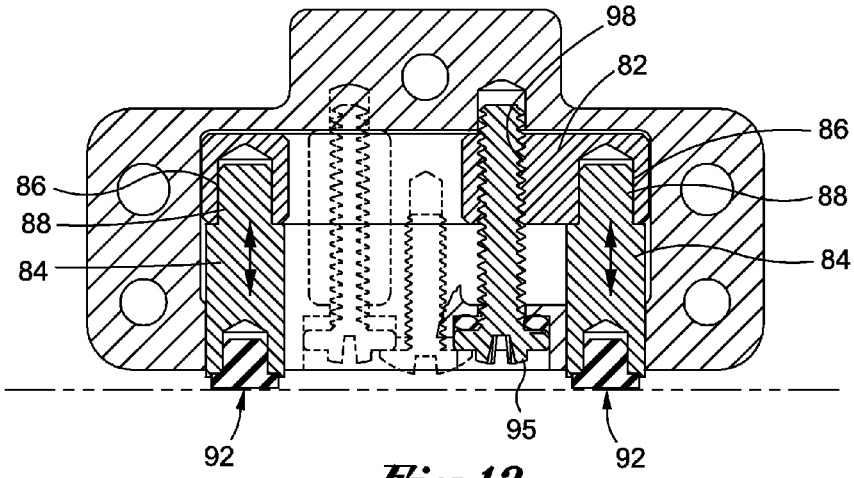
FIG. 12 is a partial top cross sectional view of the wire strike assembly depicted in FIG. 9.

Referring now specifically to FIGS. 8-12, there is shown another embodiment of the wire strike assembly 10 including a stopper device 80 (See FIG. 11) connected to the mounting plate 28. FIG. 8 is an upper perspective view of the wire strike assembly 10 including the stopper device 80, FIG. 9 is a partial exploded upper perspective view of the wire strike assembly 10 with the first upper face 30 and the second lower face 31 exploded from the mounting plate 28, and FIG. 10 is a lower perspective view of the wire strike assembly 10 with the second lower face 31 removed from the mounting plate 28 to expose the stopper device 80.

The stopper device 80 includes a carriage member 82 and a pair of extension members 84 connected to the carriage member 82. The carriage member 82 includes a pair of internally threaded apertures 86 sized and configured to receive respective ones of the pair of extension members 84. The extension members 84 shown in FIG. 11 include elongate rods having a threaded end portion 88 configured to cooperatively engage with the internally threaded apertures 86.

Each extension member 84 defines a distal end opposite the threaded portion 88. The distal end of each extension member defines an aperture 90 configured to receive a resilient pad 92. The resilient pad 92 is configured to engage with the inner face of the drawer to mitigate damage to the drawer, and also to reduce vibration of the drawer within the drawer housing as the drawer is closed. Each resilient pad 92 includes a head portion 94 and a stem portion 96 extending from the head portion 94. The stem portion 96 is sized to be inserted within a respective one of the pair of apertures 90 to connect the resilient pad to the extension member 84.

The carriage member 82 is additionally in operative communication with a stopper adjuster 95 to allow for adjustment of the carriage member 80 relative to the mounting plate 28. According to the embodiment shown in FIG. 11, the carriage member 80 includes an internally threaded aperture 98 configured to engage with the stopper adjuster 95, which is comprised of an externally threaded screw. The screw 95 and the carriage member 80 are configured such that rotation of the screw 95 results in translation of the carriage member 80 relative to the mounting plate 28 between an extended configuration, wherein the distal end of the extension member 84 extends from the mounting plate 28, and a retracted position, wherein the distal end of the extension member 84 is disposed adjacent the mounting plate 28, as shown in FIGS. 8-10 and 11. When the extension member 84 is moved from the retracted position toward the extended position, each extension member 84 defines an exposed portion as that portion of the extension member 84 extending from the mounting plate 28. Thus, as the extension member 84 moves toward the extended configuration, the exposed portion of each extension member 84 increases.

One embodiment of the carriage member 82 includes a cutout or notch 98 to accommodate the wire strike slide 52 which is also located within the mounting plate 28. In this regard, the carriage member 82 may move independent of the wire strike slide 52. In other words, a user may independently adjust the position of the wire strike 18 via the wire strike adjustment member 40, as well as independently adjust the position of the carriage member 82 via the stopper adjuster 95.

A user may adjust the distance which the extension members 84 extend from the mounting plate 28 by rotating the stopper adjuster 95. In this regard, the amount of extension may be adjusted to accommodate the particular size and configuration of the corresponding drawer. The locking mechanism 46 may be configured to lock the stopper adjuster 95 and wire strike adjuster 40.

Those skilled in the art will also appreciate that although the embodiment depicted in FIGS. 8-12 include a pair of extension members 84, other embodiments of the stopper device 80 may include a single extension member 84 or more than two extension members 84.

Figure 13:
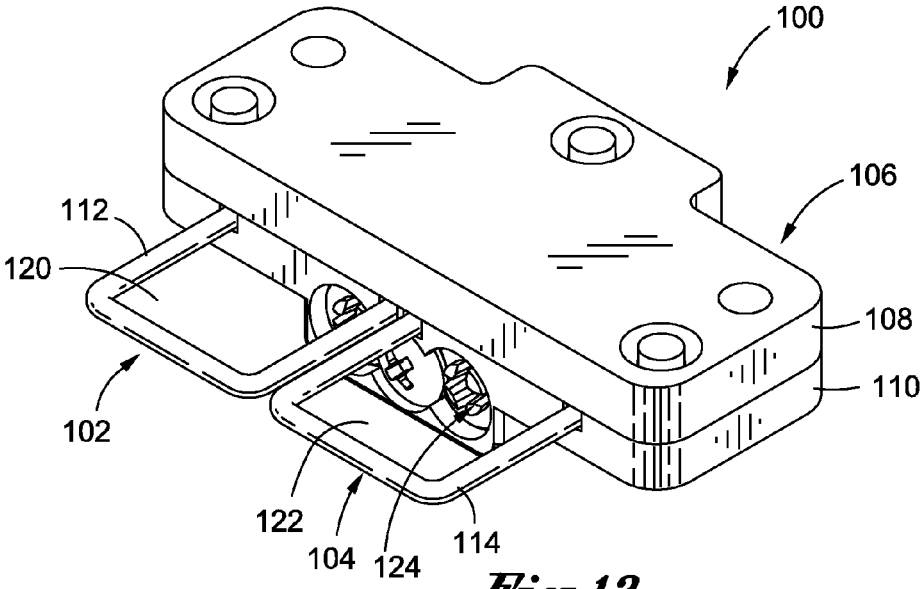
FIG. 13 is an upper perspective view of an embodiment of a wire strike assembly including a pair of wire strikes extending from the mounting body.
Figure 14:
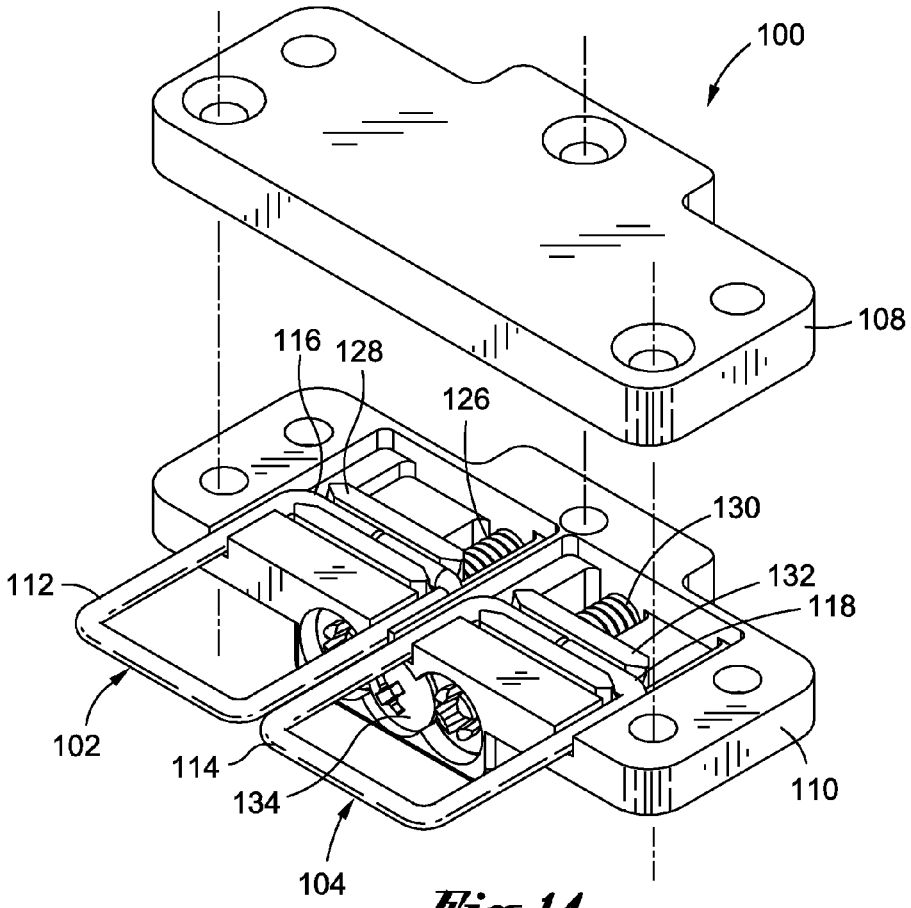
FIG. 14 is an exploded upper perspective view of the wire strike assembly depicted in FIG. 10.

Referring now specifically to FIGS. 13 and 14, there is shown another embodiment of a wire strike assembly 100 including a pair of wire strikes, i.e., a first wire strike 102 and as second wire strike 104. The multiple wire strikes 102, 104 may be engageable with two separate latches mounted in side-by-side arrangement or a single latch having two separate bolts, as is common in the aerospace industry. Each wire strike 102, 104 may have sufficient strength to independently secure the drawer in a locked and closed configuration.

The wire strike assembly 100 includes a mounting plate 106 comprised of a first plate 108 and a second plate 110. The first plate 108 is attached to the second plate 110 via mechanical fasteners, including rivets, screws, adhesives or other fasteners known by those skilled in the art. The wire strikes 102 and 104 are coupled to the mounting plate 106 in a manner wherein a portion of the first wire strike 102 and second wire strike 104 extends from the mounting plate 106 to define respective exposed portion 112, 114, and respective embedded portions 116, 118 (See FIG. 14). The first exposed portion 112 of the first wire strike 102 and the mounting plate 106 collectively define a first opening 120. Likewise, the second exposed portion 114 of the second wire strike 104 and the mounting plate 106 collectively define a second opening 122. The first wire strike 102 is selectively adjustable relative to the mounting plate 106 to adjust the first exposed portion 112, and the corresponding size of the first opening 120 to accommodate the latch that is to be received within the first opening 120. Likewise, the second wire strike 104 is selectively adjustable relative to the mounting plate 106 to adjust the second exposed portion 114 and the corresponding second opening to conform to the size of the latch that is to be received within the second opening 122. Along these lines, the wire strike assembly 100 additionally includes an adjustment mechanism 124 that is operatively coupled to the first wire strike 102 and second wire strike 104 to allow for the selective adjustment of the first wire strike 102 and second wire strike 104 relative to the mounting plate 106.

In the embodiment depicted in FIGS. 13 and 14, the adjustment mechanism 124 includes a first rotation member 126 and a corresponding first slide member 128 for adjusting the first wire strike 102. The adjustment mechanism 124 also includes a second rotation member 130 and a corresponding second slide member 132 for adjusting the second wire strike 104. As depicted in FIG. 14, the embedded portion 116 of the first wire strike 102 is disposed within a groove formed within the first slide member 128. The first slide member 128 is positioned within a groove or channel formed within the second plate 110. The first rotation member 126 and first slide member 128 are configured such that when the rotation member 126 rotates, the first slide member 128 translates relative to the first rotation member 126 and the mounting plate 106. In this regard, the first rotation member 126 and first slide member 128 may include cooperatively engageable threads and grooves to facilitate the above-described movement. Since the first wire strike 102 is coupled to the first slide member 128, the first wire strike 102 also translates relative to the mounting plate 106. The second rotation member 130 and second slide member 132 operate in similar fashion. In this regard, the second wire strike 104 is coupled to the second slide member 132 and translates relative to the mounting plate 106 in response to rotation of the second rotation member 130.

In the embodiment depicted in FIG. 14, the first wire strike 102 is independently adjustable relative to the second wire strike 104. However, it is contemplated that other embodiments may include an adjustment mechanism 124 that allows for simultaneous adjustment of the first and second wire strikes 102, 104. In this regard, such an embodiment allows the first and second wire strikes 102, 104 to be adjusted at the same time as well as the same distance.

The wire strike assembly 100 additionally includes a locking mechanism 134 which may restrict further adjustment of the first wire strike 102 and second wire strike 104. In the exemplary embodiment, the locking mechanism 134 is a screw which may be tightened to further restrict rotation of the first rotation member 126 and second rotation member 130. More specifically, as the locking mechanism 134 is moved toward a locked configuration, the head of the locking mechanism 134 engages with the first rotation member 126 and second rotation member 130 to restrict further rotation thereof.

It is additionally contemplated that various embodiments of the wire strike assembly 100 may include stop members 80 as described in more detail above. The stop members 80 may be coupled to the mounting plate 106 to mitigate damage to the drawer when the drawer is closed, as well as to reduce vibration of the drawer as it is closed.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A wire strike assembly for use with a drawer housing, the drawer housing having a top face, and a drawer with a front face and a spring-biased latch mountable to the front face, the wire strike assembly comprising:

a wire strike having a wire strike first end portion, an opposing wire strike second end portion, and a wire strike first side portion, the wire strike second end portion sized and configured to receive the spring-biased latch;

a mounting plate having a first face mountable to the top face of the drawer housing, a first channel, a second channel, and a first wire strike groove, the first wire strike groove sized and configured to receive the wire strike first side portion;

an adjustment screw having an adjustment head and a threaded adjustment stem disposable through the first channel;

a locking screw having a locking head and a locking stem, the locking screw being disposable in the second channel, the locking screw operative to lock the axial position of the adjustment screw with the locking head disposed against the adjustment head; and a wire strike slide having a recess sized and configured to receive the wire strike first end portion, the wire strike slide further having a strike opening sized and configured to engage the threaded adjustment stem, the wire strike being adjustable into a plurality of positions relative to the spring-biased latch with the rotation of the threaded adjustment stem through the strike opening translated into the movement of the wire strike slide in a direction parallel to a wire strike longitudinal axis.

2. The wire strike assembly as claimed in claim 1, wherein the wire strike has a wire strike second side portion opposing the wire strike first side portion.

3. The wire strike assembly as claimed in claim 2, wherein the wire strike has a rectangular shape with the wire strike first end portion and the wire strike second end portion being orthogonally disposed between the wire strike first side portion and the wire strike second side portion, the wire strike first side portion being generally parallel to the wire strike second side portion, the wire strike first side portion and the wire strike second side portion being longer than the wire strike first end portion and the wire strike second end portion.

4. The wire strike assembly as claimed in claim 2, wherein the mounting plate has a second wire strike groove opposing the first wire strike groove, the second wire strike groove sized and configured to receive the wire strike second side portion.

5. The wire strike assembly as claimed in claim 1, wherein the first channel is threaded to correspond to the threading pattern on the threaded adjustment stem.

6. The wire strike assembly as claimed in claim 1, wherein the mounting plate has a first channel notch proximate to the first channel sized and configured to engage the threaded adjustment stem.

7. The wire strike assembly as claimed in claim 1, wherein the locking stem is threaded.

8. The wire strike assembly as claimed in claim 7, wherein the second channel is threaded to correspond to the threading pattern on the locking stem.

9. The wire strike assembly as claimed in claim 1, wherein the strike opening on the wire strike slide is a threaded hole operative to engage the threaded adjustment stem.

10. A drawer latching device for use with a drawer housing and drawer body having a latch, the drawer body being moveable within the drawer housing a between an open position and a closed position, the latching device comprising:

a mounting body attachable to the drawer housing;

a first wire strike moveably mounted to the mounting body, a portion of the first wire strike extending from the mounting body to define a first exposed end portion, the mounting body and the first exposed end portion collectively defining a first opening sized to receive a portion of the latching device when the drawer body is moved to the closed position;

a wire strike adjustment mechanism operatively coupled to the first wire strike, the adjustment mechanism being configured to move the first wire strike relative to the mounting body to adjust the size of the first opening;

a stopper device moveably coupled to the mounting body, the stopper device having an extension member defining an exposed portion as the portion of the extension member extending from the mounting body, the exposed portion being extendable via movement of the stopper device relative to the mounting body; and wherein the stopper device further includes a carriage member coupled to the extension member, the carriage member being translatable relative to the mounting member.

11. The wire strike assembly as recited in claim 10, further comprising a stopper adjuster operatively coupled to the carriage member, the stopper adjuster and carriage member being configured such that rotation of the stopper adjuster facilitates translation of the carriage member.

12. A drawer latching device for use with a drawer housing and drawer body having a latch, the drawer body being moveable within the drawer housing between an open position and a closed position, the latching device comprising:

a mounting body attachable to the drawer housing;

a first wire strike moveably mounted to the mounting body, a portion of the first wire strike extending from the mounting body to define a first exposed end portion, the mounting body and the first exposed end portion collectively defining a first opening sized to receive a portion of the latching device when the drawer body is moved to the closed position;

a wire strike adjustment mechanism operatively coupled to the first wire strike, the adjustment mechanism being configured to move the first wire strike relative to the mounting body to adjust the size of the first opening; and wherein the adjustment mechanism includes a slide member and a rotation member coupled to each other, the slide member being configured to translate relative to the mounting body in response to rotation of the rotation member, the slide member being coupled to the first wire strike.

13. The wire strike assembly as recited in claim 12, wherein the mounting body includes a first body member and a second body member coupled to the first body member, the first body member defining a slide cavity sized to slidably receive the slide member.

14. The wire strike assembly as recited in claim 12, wherein the slide member and rotation member include complimentary threads.

* * * * *